US006257536B1

(12) United States Patent
Manuel

(10) Patent No.: US 6,257,536 B1
(45) Date of Patent: Jul. 10, 2001

(54) MERCHANDISE DISPLAY DEVICE

(76) Inventor: Alves J. Manuel, 2100 Capital Dr., Wilmington, NC (US) 28405

( * ) Notice: Subject to any disclaimer, the term of this patent is extended or adjusted under 35 U.S.C. 154(b) by 0 days.

(21) Appl. No.: 09/564,440

(22) Filed: May 4, 2000

Related U.S. Application Data

(60) Provisional application No. 60/141,686, filed on Jun. 30, 1999.

(51) Int. Cl.[7] ..... G09F 7/06

(52) U.S. Cl. ..... 248/220.31; 248/205.1; 40/657; 40/622; 40/489

(58) Field of Search ..... 248/220.1, 220.31, 248/220.41, 298.1; 411/41, 508, 913, 339; 446/85, 108; 40/20 R, 657, 622, 22

(56) References Cited

U.S. PATENT DOCUMENTS

| | | | | |
|---|---|---|---|---|
| 2,123,081 | * | 7/1938 | Sadenwater | 202/92 |
| 2,139,244 | * | 7/1938 | Nauert | 62/126 |
| 2,939,731 | * | 6/1960 | Fry | 287/53 |
| 3,089,269 | * | 5/1963 | McKiernan | 40/143 |
| 3,154,281 | * | 10/1964 | Frank | 248/201 |
| 3,229,944 | * | 1/1966 | Everburg | 248/223 |
| 3,319,917 | | 5/1967 | Bilodeau | 248/225 |
| 4,196,691 | * | 4/1980 | Imazeki | 116/309 |
| 4,539,766 | | 9/1985 | Fast | 40/22 |
| 4,694,596 | | 9/1987 | Fast | 40/20 R |
| 5,260,726 | | 11/1993 | Nyman | 351/158 |
| 5,673,887 | * | 10/1997 | Hollingsworth | 248/220.31 |
| 5,678,794 | * | 10/1997 | Kump | 248/220.31 |
| 5,906,283 | | 5/1999 | Kump et al. | 211/54.1 |

* cited by examiner

*Primary Examiner*—Leslie A. Braun
*Assistant Examiner*—Steven Marsh
(74) *Attorney, Agent, or Firm*—Dougherty & Clements LLP

(57) ABSTRACT

An improved method and apparatus for removably attaching display items to a subsrate, has been invented by incorporating a slot in the peg to provide flexibility to the peg member, which allows it to conform to the size of the corresponding hole in the substrate, which can vary in diameter depending upon the manufacturing process.

17 Claims, 2 Drawing Sheets

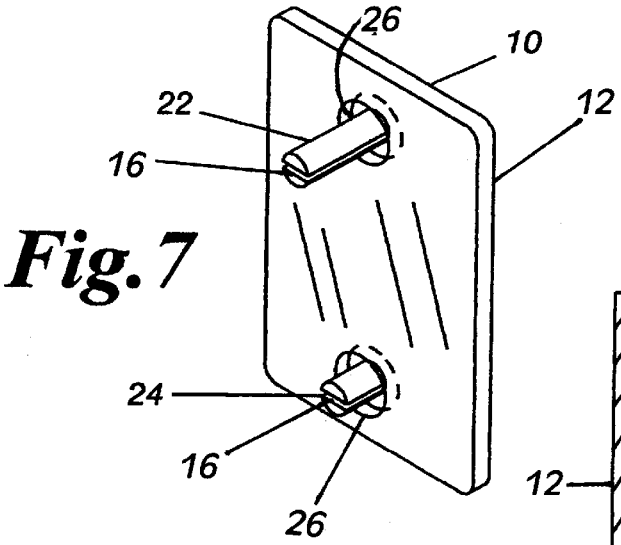
Fig. 7
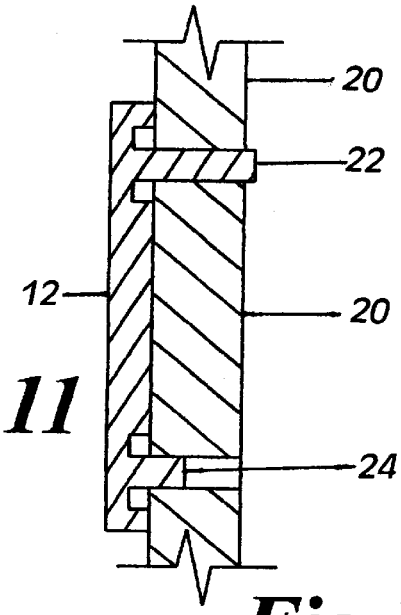
Fig. 11
Fig. 10
Fig. 8
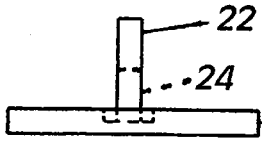
Fig. 9
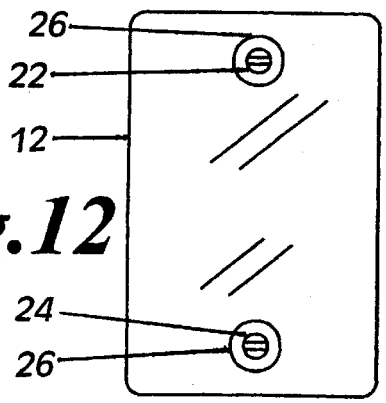
Fig. 12
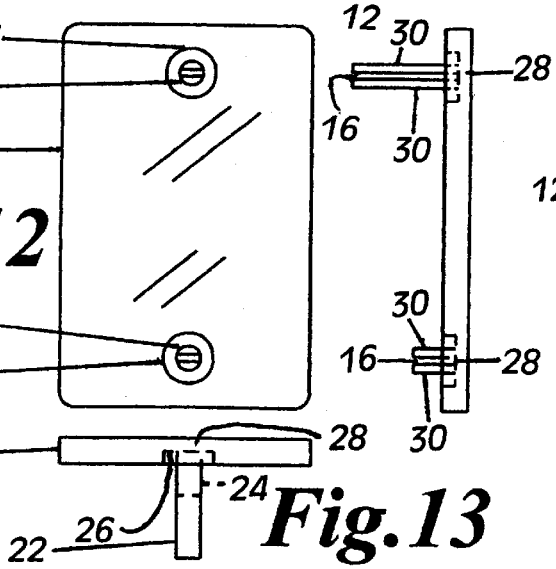
Fig. 13
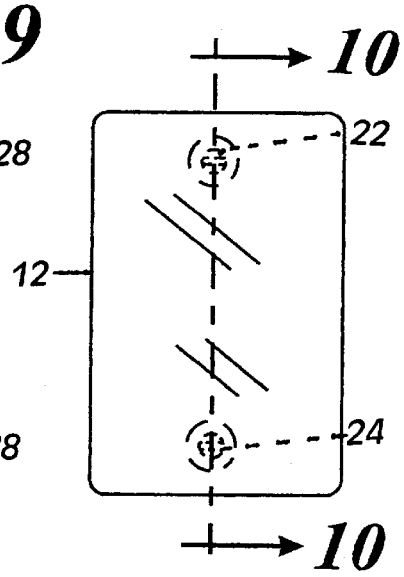

MERCHANDISE DISPLAY DEVICE

CROSS REFERENCE TO RELATED APPLICATION

This application claims the benefit of U.S. Provisional Application No. 60/141,686, filed on Jun. 30, 1999.

FIELD OF THE INVENTION

The present invention relates to a method and apparatus for removably attaching display items to a substrate, and more particularly to a method and apparatus for removably attaching a display item to a substrate using slotted pegs attached to an attachment system that allows the attachment system to fit securely against the substrate.

BACKGROUND OF THE INVENTION

Display systems are commonplace in every store. Display systems, such as eyeglass display systems, come in various forms, including a wall display embodiment. The wall display will generally have an acrylic or other clear polymer based wall and a plurality of nosepiece units attached to the wall for allowing an eyepiece to straddle each nosepiece. The nosepiece is typically attached to the wall by an adhesive. In another example, removable nosepiece units are used that include a hook on the attachment portion of the nosepiece for fitting into a slot formed in the wall.

Current display attachment systems are made of either a rigid plastic or a metal alloy which have very little elasticity. These rigid plastic or metal alloy attachment systems cannot accommodate an oversized or undersized hole in the substrate. These rigid systems also cannot accommodate a hole that was bored on a skewed angle. Variations in hole sizes in the substrate are typically caused by variation in tooling sizes. What is needed is a display attachment system that can accommodate a variety of sizes of peg-receiving holes.

Applicant is aware of the following U.S. Patents:

| U.S. Pat. No. | Issued | Inventor | Title |
|---|---|---|---|
| 2,123,081 | 2/8/37 | Sadenwater | FASTENING FOR TENON-JOINTS |
| 2,139,244 | 7/3/38 | Nauert | REFRIGERATOR |
| 2,939,731 | 2/1/57 | Fry | CONTROL SHAFT |
| 3,089,269 | 3/3/60 | McKiernan | PEGBOARD SIGN |
| 3,154,281 | 2/20/62 | Frank | HOLDER FOR ELECTRONIC COMPONENTS |
| 3,229,944 | 1/18/66 | Everburg | DISPLAY FIXTURE |
| 4,196,691 | 4/8/80 | Imazeki | MANUALLY ROTATABLE CONTROL OR SELECTOR KNOB MEMBER |
| 5,673,887 | 10/7/97 | Hollingsworth et al | FASTENER FOR HOLDING OBJECTS TO A PERFORATED WALL |
| 5,678,794 | 10/21/97 | Kump | ADJUSTABLE LENGTH PEGBOARD SIGN HOLDER |

Sadenwater, U.S. Pat. No. 2,123,081, teaches a fastening method using tenon joints, the tenon joints having a longitudinal slit extending from a free end of a tenon to a point just beyond a shoulder of the tenon.

Nauert, U.S. Pat. No. 2,139,244, teaches an improved cooling unit for refrigerators having one or more baffle plates secured thereon in such a manner that each baffle plate is quickly mounted on and easily removed from the cooling unit shell.

Fry, U.S. Pat. No. 2,939,731, teaches a generally cylindrical control shaft for use with a suitable electrical control mechanism. The control shaft comprises segmental portions that are divided by a slot, separated and spaced apart in order to provide a tight antiback lash connection with a control knob.

McKiernan, U.S. Pat. No. 3,089,269, teaches a three dimensional display sign having a mounting board and indicia-forming elements that may be quickly and easily mounted on or removed from the board. The mounting board comprises a pegboard having a plurality of evenly distributed socket openings for receiving plug members that are permanently anchored to the indicia forming elements.

Frank, U.S. Pat. No. 3,154,281, teaches an electronic components holding device that is attachable to a panel by an integral shank having a frusto-conical head. The shank and head have a pair of diametrical slots formed through a shank axis resulting in four barbed prongs. The shank holder utilizes inherent material properties of resilience, deformation, and recovery for locking the device to a panel having holes for receiving the prongs.

Everburg, U.S. Pat. No. 3,229,944, teaches a display fixture particularly adapted for displaying spectacle frames or the like articles in merchandising exhibits. The fixture includes a mounting plate, a spectacle receiving tray, and a support bracket interconnecting the plate and tray. The mounting plate includes a circumferentially grooved lug integrally formed with the plate and extending rearwardly. The mounting plate is intended to be connected to a wall or merchandising display panel through pegboard like openings by inserting the grooved lugs through the openings and securing with retaining clips. Everburg also discloses a tray for holding eyeglasses. Everburg further discloses forming the pegs with an acrylic plastic or other thermoplastic.

Imazeki, U.S. Pat. No. 4,196,691 teaches a manually rotatable control assembly having a selector knob member adapted to be connected to an operating shaft of an electrical or electronic device. The operating shaft is longitudinally slotted and fastly coupled with a locking hole formed in the knob member.

Hollingsworth, U.S. Pat. No. 5,673,887, teaches a fastener for holding objects to a perforated wall. The fastener has three portions: a first portion for securing an object against movement relative to the fastener, a second portion connected to the first portion for passing into the hole in the wall and extending to the rear wall surface, and a third portion passable through the hole and after passing through the hole, extending radially outward from the periphery of the hole. The third portion offers resistance to removal of the fastener from the hole in a rear-to-front direction. Many embodiments of the fastener are disclosed.

Kump, U.S. Pat. No. 5,678,794, teaches a variable length sign holder attachable to a pegboard and a plate and a stub extending from the plate for insertion into a hole on the pegboard. The stub comprises a longitudinal shaft and spaced ribs that extend radically outward therefrom. Kump further disclose forming the pegs with an acrylic plastic or other thermoplastic.

SUMMARY OF THE INVENTION

The present invention provides an improved attachment system that is removably attachable to a substrate. The substrate has holes or openings of nonuniform sizes due to variations in the manufacturing process. The attachment system has a face plate to which display items are attached and a pair of slotted round pegs are fixedly attached to the back of the face plate. The slots form half-round bars which have sufficient flexibility to change the dimensions of the peg and frictionally engage a surface of the holes or openings. The slotted pegs allow the invented attachment system to accommodate a variety of peg-receiving holes or opening. In particular, the slotted pegs may be compressed to snugly conform to the diameter of the peg-receiving hole. The invention also provides greater stability to display items than traditional attachment systems because the pegs extend through the substrate and out the other side.

OBJECTS OF THE INVENTION

The principal object of the present invention is to provide an improved attachment system for removably attaching display items to a substrate.

Another, more particular object of this invention is to provide a display attachment system for use with a substrate having holes of nonuniform diameters due to variations in the manufacturing process.

Another object of this invention is to provide an improved attachment system having attachment pegs of different lengths.

Another, more particular object of this invention is to provide an improved attachment system that is removably attachable to a substrate and has attachment pegs of lengths greater than the depth of the substrate to provide increased stability.

BRIEF DESCRIPTION OF THE DRAWINGS

The foregoing and other objects will become more readily apparent by referring to the following detailed description and the appended drawings in which:

FIG. 7 is an isometric view of an alternative embodiment of the attachment system.

FIG. 8 is a top view of the attachment system.

FIG. 9 is a side view of the attachment system.

FIG. 10 is a rear view of the attachment system.

FIG. 11 is a cross section view taken along line 10—10 of FIG. 10 of the attachment system attached to a portion of a substrate.

FIG. 12 is a front view of the attachment system.

FIG. 13 is a bottom view of the attachment system.

DETAILED DESCRIPTION

Figure 1:
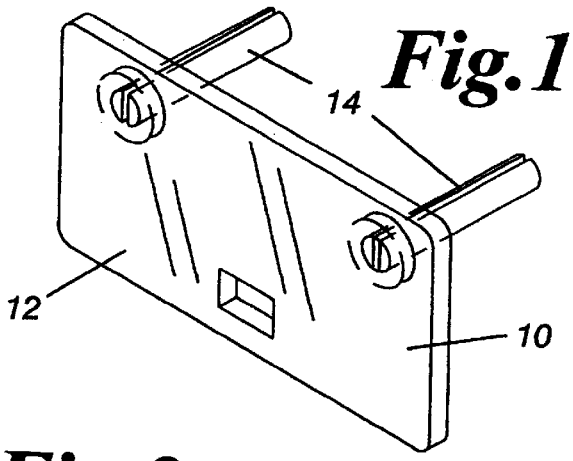
FIG. 1 is an isometric view of a preferred embodiment of the invented attachment system.
Figure 2:
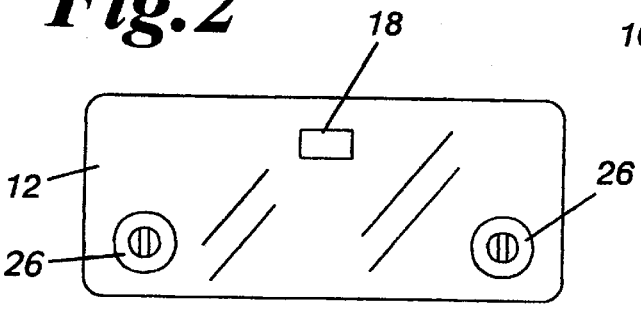
FIG. 2 is a front view of the attachment system.

Referring now to the FIGS. 1 through 6, and more particularly to FIG. 1, which shows an attachment system 10 for displaying items in a horizontal manner, the attachment system 10 has a display platform 12 or face plate and a pair of substantially cylindrical pegs 14. FIG. 2 shows the face plate 12 with a slot 18 and a circular channel 26. The circular channel 26 creates a thin wall section 28 of the face plate 12.

Figure 3:
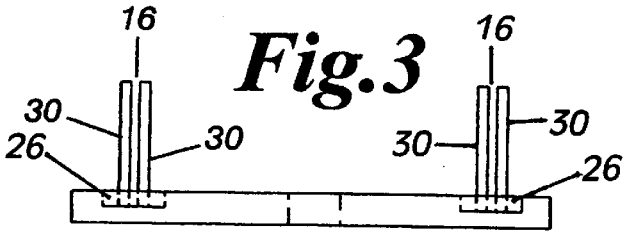
FIG. 3 is a top view of the attachment system.
Figure 4:
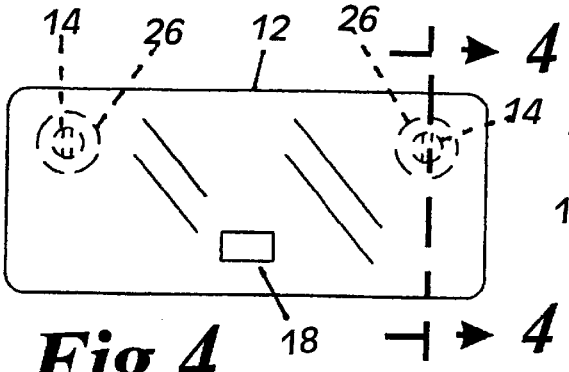
FIG. 4 is a rear view of the attachment system.
Figure 5:
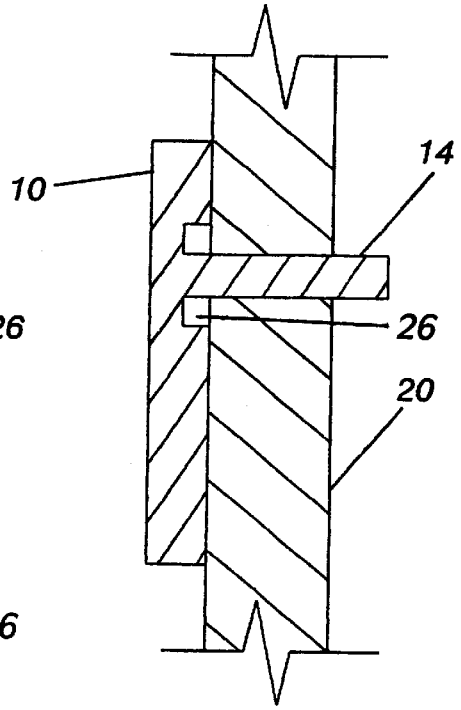
FIG. 5 is a cross section view taken along line 4—4 of FIG. 4 of the attachment system attached to a portion of a substrate.
Figure 6:
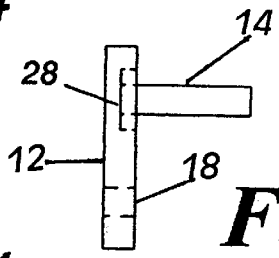
FIG. 6 is a side view of the attachment system.

Each peg 14 is long enough to penetrate the substrate 20 and extend out the opposite side and has a slot 16 formed there through along the longitudinal axis of the peg 14. FIG. 3 shows the slot 16 in each peg 14, which forms a pair of half round bars 30. Each bar 30 has a rounded outer surface for frictionally engaging an interior surface of the openings in the substrate 20. Each bar 30 also has a flat surface, although it is not critical that the surface be flat. In the drawings, the direction of the slots 16 are parallel so that the flat surface of each bar 30 within each peg oppose each other. However, the direction or orientation of the slots 16 is not critical. In addition, the shape of each bar 30 is not critical, but the shape must provide sufficient surface area for the outer surface of each bar 30 to frictionally engage a corresponding surface of a mating bar-receiving opening of the substrate 20, as shown in FIG. 5. The substrate 20 has a plurality of holes to receive a peg from the attachment system 10. The substrate 20 can be made of plastic, fiber board, wood, pressed wood, or any other similar material.

Each peg 14 is fixably attached within the circular channel 26 and adjacent to the thin wall section 28 of the face plate 12. In the preferred embodiment, the pegs 14 and face plate 12 are formed from one unitary piece of transparent plastic. In the most preferred embodiment, the system is manufactured via injection molding.

In a preferred embodiment the length of the peg 14 is greater than the depth of the substrate 20, as best shown in FIG. 5, which provides greater stability to the attachment system.

Referring now to the FIGS. 7 through 13, and more specifically to FIG. 7, a second embodiment shows an attachment system that displays items in a vertical manner. The longer peg 22 is long enough to penetrate the substrate 20 and extend out the opposite side. The long peg 22 securely attaches the system 10 to a substrate 20. The shorter peg 24 is long enough to penetrate the substrate 20 but does not extend out the opposite side. The shorter peg 24 permits easy removal of the attachment system 10 from the substrate 20. The circular channel 26 creates a thin wall section 28 of the face plate 12.

Each peg 22, 24 has a slot 16 formed there through along the longitudinal axis of the peg 22, 24. FIG. 9 shows the slot 16 in each peg 22, 24 which forms a pair of half round bars 30. Each bar 30 has a rounded outer surface for frictionally engaging an interior surface of the openings in the substrate 20. Each bar 30 also has a flat surface, although it is not critical that the surface be flat. In the drawings, the direction of the slots are parallel so that the flat surface of each bar within each peg oppose each other. However, the direction or orientation of the slots is not critical. In addition, the shape of each bar 30 is not critical, but the shape must provide sufficient surface area for the outer surface of each bar 30 to frictionally engage a corresponding surface of a mating bar-receiving opening of the substrate 20, as shown in FIG. 11.

In the operation of the invented attachment system 10, a force is applied transverse to the round, outer surface of the half-round bars. The round, outer surface is put into tension and the flat, inner surface is put into compression. The applied forces cause sufficient deformation for the dimensions of the peg to conform to the dimensions of the opening. The round surface then frictionally engages the interior surface of the opening.

Once the invented system 10 is attached to the substrate 20, a nosepiece may be attached to the face plate 12. If the face plate 12 is slotted 18, a removable nosepiece may rest in the slot 18. Display attachments that can be attached to the face plate 12 are not limited to a nosepiece or the like.

In the preferred embodiment, the dimensions of the invention correspond to industry standards. However, such dimensions as the size of the face plate and the distance from one peg to another may be varied to achieve the objective of the invention.

In the preferred embodiment, the system is constructed from a flexible, transparent plastic. Polycarbonate plastic is customarily used. However, the optical properties of the material used to construct the system is not critical. In addition, the pegs merely require sufficient flexibility to deform to fit into the hole.

The system may be constructed from one or more thermoplastics, thermosets, or elastomers. Thermoplastics includes common commodity thermoplastics and specialty plastics. Common commodity thermoplastics include, but are not limited to, acetals, acrylics, high density polyethylene (HDPE), low density polyethylene (LDPE), polypropylene (PP), polystyrene (PS), poly vinylchloride (PVC), polyethylene terephthalate (PET), acrylonitrile-butadiene-styrene (ABS), high impact polystyrene (HIPS), and nylon. Specialty thermoplastics include, but are not limited to, polyether sulfones(PES), polyphenylene ethers (PPE), and polyphenylene sulfides (PPS). Thermosets include, but are not limited to, polyurethanes, polyimides, epoxies, and polyesters. Elastomers or rubbers include isoprenes, neoprenes, chloroprenes, silicones, butadienes, styrene-butadiene rubber (SBR), or ethylene-propylene rubbers (EPM or EPDM).

The chemical composition and physical properties of the plastics used to construct the system are also not critical, as long as the materials provide the desired flexibility. The polymers or plastics can be homopolymers, copolymers, blends, alloys, or mixtures. The polymers or plastics can be amorphous, crystalline, or semi-crystalline. The plastics may also be reinforced, filled, or plasticized.

The system 10 may also be constructed out of metals or other materials with sufficient flexibility to construct pegs capable of sufficient deformation without fracture. Possible metals include, but are not limited to, aluminum, steel, stainless steel, nickel, titanium, copper, brass, and tin.

The system 10 may also be constructed out of composite systems, such as wood.

The slot 16 may have any shape that allows a standard or non-standard nosepiece, trays, bins, sign card holders, shelves, or displays for other retail items to attach to the face plate.

SUMMARY OF THE ACHIEVEMENT OF THE OBJECTS OF THE INVENTION

From the foregoing, it is readily apparent that I have invented an improved attachment system for removably attaching a substrate having holes of nonuniform diameters due to variations in the manufacturing process, an improved attachment system having pegs of different lengths that removably attaches to a substrate that has holes of nonuniform diameters due to variations in the manufacturing process, and an attachment system which is removably attachable to a substrate and has pegs of lengths greater than the depth of the substrate to provide increased stability.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. An attachment system for removably connected display items to a substrate a face plate having a narrow width, and a height and length several times greater than the width and having recessed areas which form thin walled sections in said face plate;

a plurality of pegs having a generally uniform cross-sectional body, a terminal end having a cross-section substantially the same size or no larger than said body and said pegs extend through said recessed areas and are secured to said thin walled sections and wherein said pegs have first and second transverse sections defining a generally longitudinal slot therebetween wherein said slot extends from said terminal end of said pegs to within said recessed areas whereby said recessed areas allow the pegs a more durable connection to the face plate.

2. The merchandising display device according to claim 1 wherein said body has an outer surface at a maximum radial distance from the center of said body at least every 45°.

3. The merchandise display device according to claim 2 wherein said body has a generally circular cross-sectional area.

4. The attachment system according to claim 1 wherein said pegs have a plurality of transverse sections defining a plurality of slots therebetween wherein said slots extend from said terminal end of said pegs to within said recessed areas.

5. The attachment system according to claim 3 wherein said transverse sections deform radially inward when inserted within substrate openings which interfere with the insertion of said pegs.

6. The attachment system according to claim 3 wherein said transverse sections are transient radially inward when inserted within substrate openings which interfere with the insertion of said pegs.

7. The attachment system according to claim 6 wherein said transverse sections are biased towards a neutral position.

8. The attachment system according to claim 7 wherein said pegs are frictionally held within said substrate openings.

9. The attachment system according to claim 8 wherein said pegs are not threaded.

10. The attachment system according to claim 8 wherein said face plate is substantially rigid.

11. The attachment system according to claim 10 wherein said face plate further includes an orifice extending at least partially through said face plate and is adaptable.

12. The attachment system according to claim 11 wherein said orifice extends through said face plate and is adaptable for holding a nosepiece.

13. The attachment system according to claim 10 wherein said face plate is adapted to be juxtaposed with said substrate when attached to said substrate.

14. The attachment system according to claim 10 wherein said face plate and said pegs are unitary and said pegs are formed at about a 90° angle to said face plate.

15. The attachment system according to claim 8 wherein said legs are substantially of equal lengths.

16. The attachment system according to claim 8 wherein at least one of said legs is shorter than the thickness of said substrate and at least one of said legs is greater than the thickness of said substrate.

17. The attachment system according to claim 8 wherein said transverse sections are opposed facing half-round bars.

* * * * *

UNITED STATES PATENT AND TRADEMARK OFFICE

CERTIFICATE OF CORRECTION

PATENT NO. : 6,257,536 B1
DATED : July 10, 2001
INVENTOR(S) : Manuel J. Alves

It is certified that error appears in the above-identified patent and that said Letters Patent is hereby corrected as shown below:

Title page,
Item [12], change "Manuel" to -- Alves --.
Item [76], change "Alves J. Manuel" to -- Manuel J. Alves --.

Signed and Sealed this

Twenty-ninth Day of January, 2002

*Attest:*

*Attesting Officer*

JAMES E. ROGAN
*Director of the United States Patent and Trademark Office*